US007207450B1

(12) United States Patent
Franklin et al.

(10) Patent No.: US 7,207,450 B1
(45) Date of Patent: Apr. 24, 2007

(54) BEVERAGE HOLDER DEVICE

(76) Inventors: Dirk R. Franklin, 79 Alpine Ave., Los Gatos, CA (US) 95030; Stephen L. Olson, 1291 Portland Ave., Los Altos, CA (US) 94024

( * ) Notice: Subject to any disclaimer, the term of this patent is extended or adjusted under 35 U.S.C. 154(b) by 112 days.

(21) Appl. No.: 10/921,697

(22) Filed: Aug. 19, 2004

(51) Int. Cl.
*A47B 43/00* (2006.01)
*E04H 15/26* (2006.01)

(52) U.S. Cl. ..... 211/205; 211/205; 211/195; 211/197; 135/99; 108/25

(58) Field of Classification Search ..... 211/205, 211/166, 195, 196, 107, 85.23, 197, 172, 211/85.24, 85.18, 85.19, 74; 248/156, 161; 135/98, 99, 28, 38, 39; 108/25, 26, 150
See application file for complete search history.

(56) References Cited

U.S. PATENT DOCUMENTS

| | | | | | |
|---|---|---|---|---|---|
| 1,520,352 | A | * | 12/1924 | Johnson | 211/10 |
| 3,130,837 | A | * | 4/1964 | Baker | 211/83 |
| 3,397,881 | A | * | 8/1968 | Hedgecock | 472/14 |
| 3,642,145 | A | * | 2/1972 | Shelton | 211/78 |
| 3,828,373 | A | * | 8/1974 | Fraley | 4/646 |
| 4,334,661 | A | | 6/1982 | Pitt | 248/146 |
| 4,856,669 | A | * | 8/1989 | Averitt et al. | 220/475 |
| D369,947 | S | * | 5/1996 | Herbert | D7/620 |
| 5,570,863 | A | | 11/1996 | Cooper | 248/146 |
| 5,823,496 | A | | 10/1998 | Foley et al. | 248/314 |
| 5,913,269 | A | | 6/1999 | Franssen et al. | 108/25 |
| 6,443,172 | B2 | | 9/2002 | Brumfield | 135/16 |
| 6,533,140 | B1 | | 3/2003 | Freeman | 220/737 |
| 6,575,417 | B1 | | 6/2003 | Krommenakker | 248/311.2 |
| 6,802,481 | B2 | * | 10/2004 | Newburn et al. | 248/145 |
| 2002/0043181 | A1 | | 4/2002 | Gist | 108/26 |
| 2002/0130236 | A1 | | 9/2002 | Swensen | 248/315 |

* cited by examiner

*Primary Examiner*—Peter M. Cuomo
*Assistant Examiner*—Lindsay M. Maguire
(74) *Attorney, Agent, or Firm*—Schneck & Schneck; Thomas Schneck; David M. Schneck

(57) ABSTRACT

A drink holder device having a ground support, a leg extending from the ground support, and a plurality of arms extending from the leg. The arms are movable between a raised and a lowered position. At the end of each arm is one or more beverage holders. A lock holds the arm in position when raised.

18 Claims, 7 Drawing Sheets

BEVERAGE HOLDER DEVICE

TECHNICAL FIELD

The present invention relates to a beverage holder device and more specifically to a portable and collapsible beverage holder device.

BACKGROUND ART

Portable collapsible devices for use in camping, backyard events, and outdoor festivals are increasingly popular. Such devices allow transport and rapid assembly of the devices. They are adaptable for storage without taking up much space. Such devices are also usually fairly lightweight allowing easy transport. Presently chairs, tables, umbrellas, and even multi-seat couches are available.

One type of such outdoor devices are drink holders for outdoor use. A number of devices have been described for holding drinks. These include a number of drink spikes that hold a single drink. Such devices generally comprise of a spike which is stuck in the ground. Extending from this spike is a drink holder receptacle. For example, U.S. Pat. No. 4,334,661 discloses a spike including a platform at the mid-level of the spike. The platform holds the bottom of a drink container. The container is able to stably be retained by a ring at the top of the spike. A variation of this general idea is seen in U.S. Pat. No. 6,575,417 in which the spike includes a U-shaped structure. This structure is driven into the ground providing two ends which may be secured in the ground. This provides a more stable base.

U.S. Pat. No. 6,533,140 discloses a beverage holder in which the can is held in a retaining well. Spikes extend from the bottom circumferential edge of the well. Again, this allows a number of protrusions to be driven into the ground to secure the cup holder. Published U.S. Patent Application No. 2002/0130236 adapts this idea to a one glass holder. In this case the spike driven into the ground extends upward and is bent to form an open ring structure. The open ring allows the stem of a wine glass to be passed through the ring. When the wine glass is lowered the wine glass is held by the ring.

Each of these devices is designed to hold a single drink. In addition, each of these devices holds a drink at ground level. A drink held at ground level is subject to being inadvertently knocked over as people walk around the location where the holder is in use. There is also a risk that the beverage container in the holder may be unintentionally contaminated with dirt or unwanted substances that are blown at ground level or kicked by those walking near the area where the drink is placed. In addition to ground level spikes, a number of devices have been described that hold one or more drinks at a level further from the ground. U.S. Pat. No. 5,823,496 discloses an elongated spike having a sharpened end for driving into the ground. Mounted on the spike is a container holder which may be selectively angled. This allows the drink holders to be level with respect to the ground even if the mounting pole is not. U.S. Patent Application No. 2002/0043181 discloses a modular personal table that includes a table top and a drink holder section, a table leg that may be disassembled, and a base section. The base may be disassembled, but does not collapse. U.S. Pat. No. 5,913,269 discloses a table including drink holders. The table has a tri-legged base joined to a table leg. A top mounted on the base includes a number of drink holding rings.

It would be advantageous to have an easily transportable fully collapsible drink holding stand for holding more than one drink. Such a device may be used outdoors as part of the patio furniture or at outdoor festivals. Such a device may even be used indoors for events at which an additional number of drink holders are useful.

SUMMARY OF THE INVENTION

The above objects are realized with a drink holder device including a leg and a ground support at one end of the leg. The ground support may be a spike, plate, auger, or tripod, or some combination of these elements. The leg may be of adjustable height allowing the device to be used for either seated users or standing users. Mounted on the leg are a plurality of arms which are movable from a lowered position to a raised position. Associated with each arm is an arm lock which allows the arm to be held securely in the raised position. Mounted on each arm is a beverage holder. The device may also include a table top secured over the arms of the device. When the arms of the device are extended to the perpendicular position, the table top forms a level or planar surface onto which additional items may be placed. The beverage holder is adaptable to holding various beverage containers such as tumbler-style glasses, beverage cans, and bottles. The beverage holder may also include wine glass holders. The wine glass holders are capable of holding most stemware. Such holders may be an open ring that allows insertion of a wine glass stem into the ring. When the glass is set down the ring holds the sides of the wine glass.

DETAILED DESCRIPTION OF THE INVENTION

Figure 1:
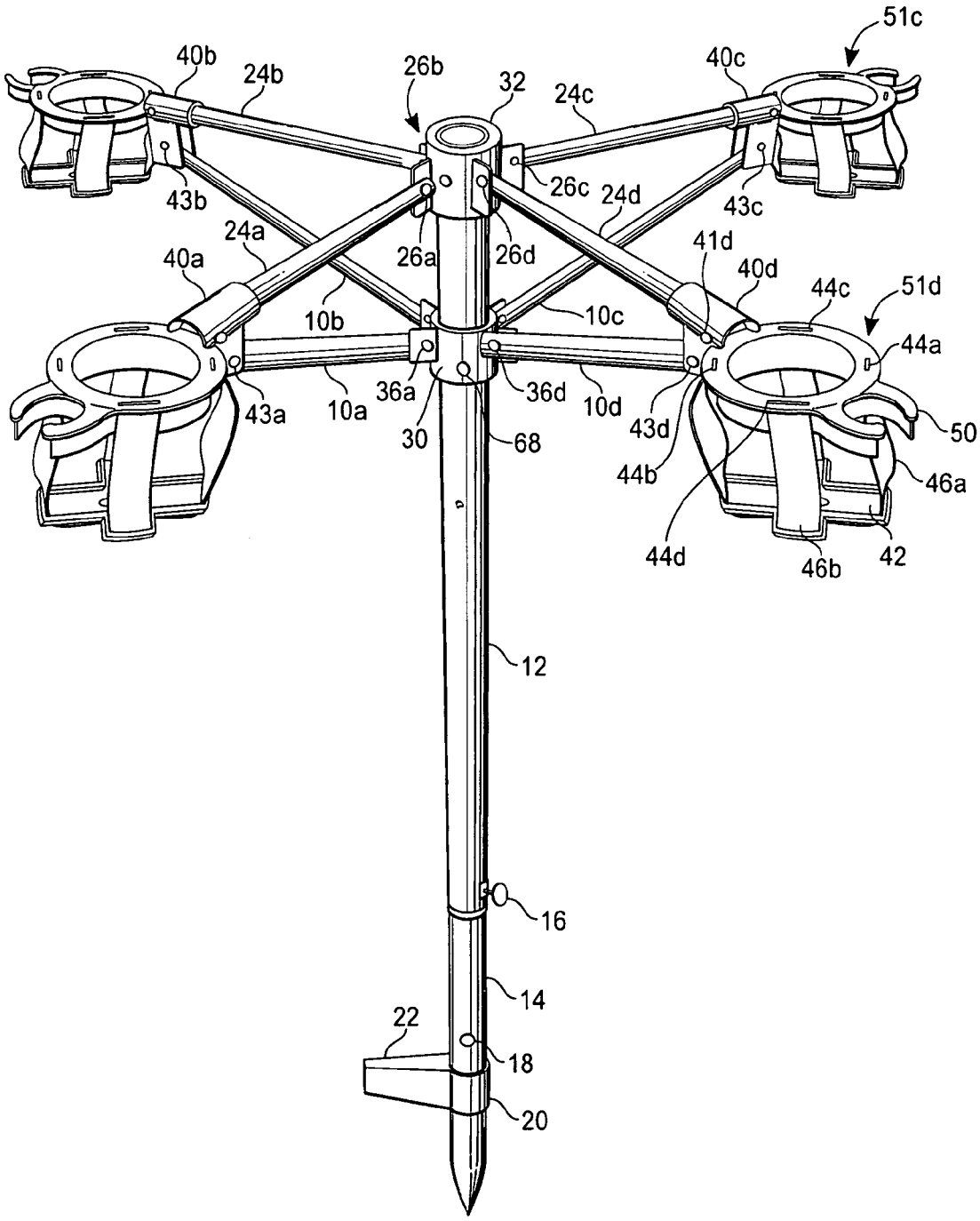
FIG. 1 is a perspective view of the present beverage holder device with the arms in the extended position.
Figure 2:
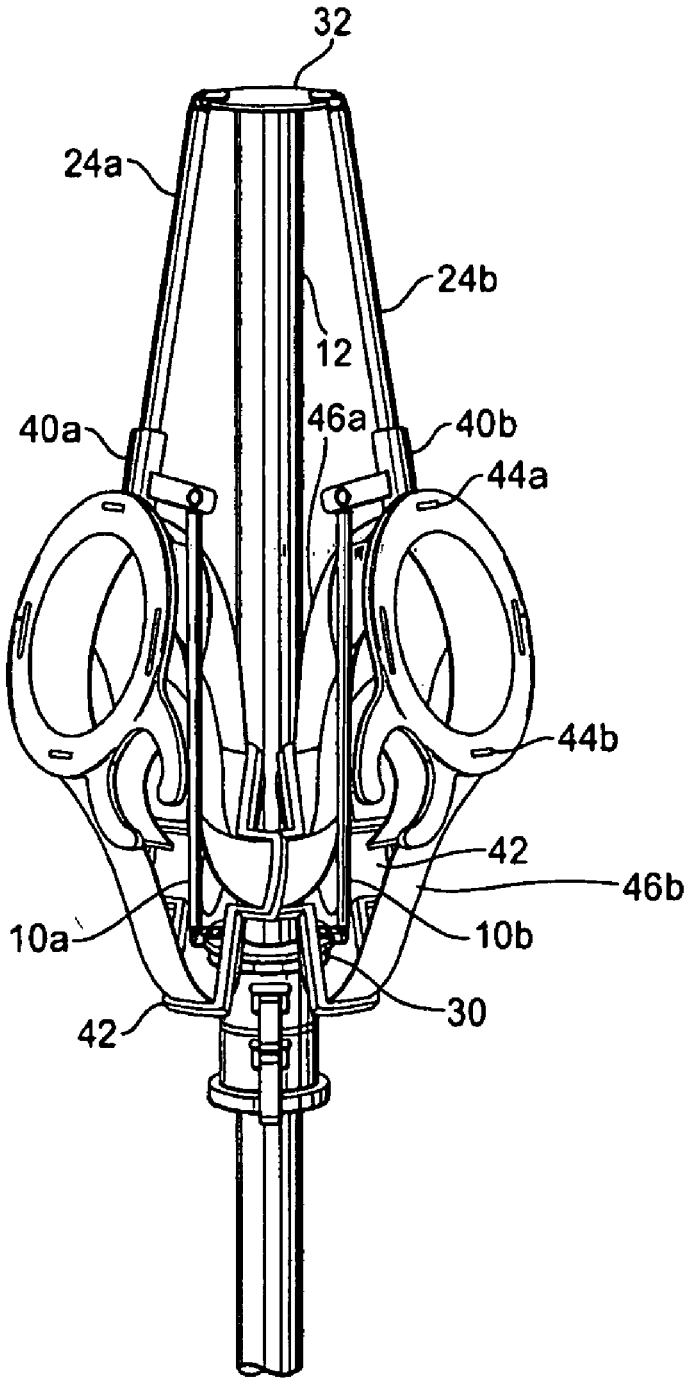
FIG. 2 is a partial view of the leg and arm section of the one embodiment with the arms in the lowered position such that the arms are substantially parallel to the legs.

FIG. 1 illustrates a first embodiment of the present invention. A drink holder includes a leg comprised of section 12 and section 14. Sections 12 and 14 in this embodiment are both tubular sections with section 12 having a interior diameter slightly larger than the exterior diameter of section 14. This allows section 14 to be inserted into section 12. Knob 16 extends through one side of section 12. Rotating knob 16 against leg tube section 14 can fix the position of section 14 in relation to section 12. This provides a means for adjusting the height of the leg. Alternatively, as shown in FIG. 2, a cam lever, an alternative friction lock or other known height adjustment devices may be used to adjust the leg height.

With reference again to FIG. 1, at the end of section 14 is a ground support means. It is preferred that the ground support means which is used allow the drink holder to be stably positioned. In the illustrated embodiment a stake 20 is inserted into the end of tubular section 14 and fixed into position by pin 18, which extends into tubular member 14. Pin 18 may be frictionally fit or received onto threads to secure pin 18 into place. Alternatively, pin 18 may be a spring loaded pin which is part of stake 20 or a screw. The spring loaded pin could be compressed to fit inside tubular member 14 then extend through a hole on tubular member 14. A perpendicular extending foot plate 70 extends from the side of stake 20. Peg 22 may also be used for ground support, and may be used in some embodiments without the plate. A user drives the stake into the ground using his foot, using body weight on the peg or plate. This both makes the stake easier to drive into the ground and adds lateral stability.

Figure 5A:
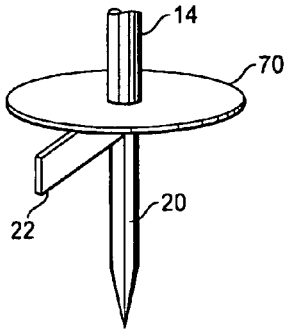
FIG. 5A is a perspective view of one embodiment of the ground support including a stake and foot platform and foot peg.
Figure 5B:
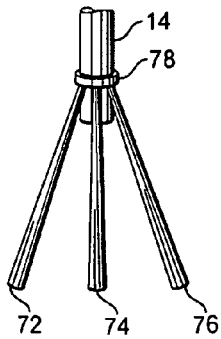
FIG. 5B is a view of a second embodiment of the ground support including a tripod element.
Figure 5C:
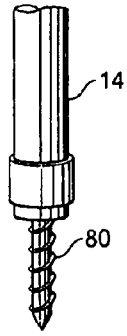
FIG. 5C is a view of the ground support including an auger.

A number of alternative ground support structures are available. A number of these are illustrated in FIGS. 5A–5E. In FIG. 5A the stake 20 has a foot platform 70 which extends about leg section 14. This foot 70 at the end of leg 14 rests at ground level and provides additional stability to the drink holder. FIG. 5B illustrates an alternative embodiment including a ring 78 positioned on leg section 14. Mounted on ring 78 are tripod legs 72, 74, 76. These legs may be positioned either substantially parallel to section 14 for storage or could be angled at about a 45 degree angle from leg section 14 in the supporting position. This allows the legs to stably support the leg of the beverage holder device. This configuration may be useful for use on decks, concrete, or other similar hard surfaces into which a stake could not be driven. Another illustrated alternative seen in FIG. 5C, an auger 80 extends from section 14. This auger may be easier to drive into the ground and more stable than a simple stake.

Figure 5D:
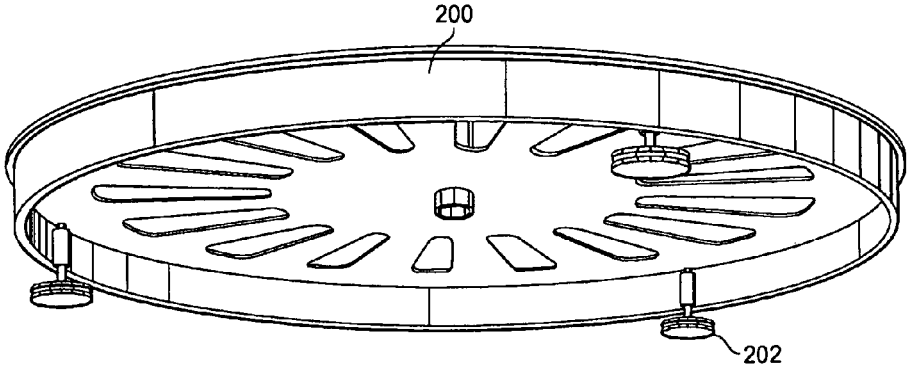
FIG. 5D is a bottom view of a hard surface base with adjustable feet.
Figure 5E:
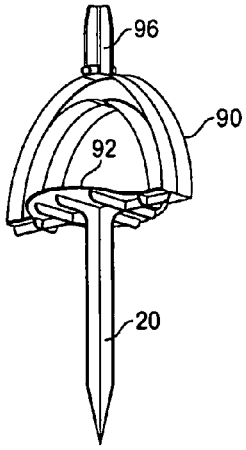
FIG. 5E is a perspective view of a stirrup-stake base.

Two additional ground supports are shown in FIGS. 5D–5E. FIG. 5E shows a stirrup shaped stake which may be attached to leg section 14 by mount 96. This stake design has an arch 90 formed of a I beam attached to a base plate 92. Below the base plate 92 is a spike 20 to hold the device firmly in the ground. This stirrup stake could be made from plastic, metal, or other suitable material.

The stirrup stake allows the user to insert their foot into the stirrup allowing for the greatest amount of force to be placed directly over the spike for best ground penetration. The stake may be attached to a leg section with a quick release pin or other such mechanism. The quick release pin allows the user to remove the stake from leg 14. This is useful in very hard soil types, the user can pound on the tapered hammer point 96 to insert the stake into the ground. The hammer point is tapered so repeated use will not interfere with reinserting the stake back into a leg section. This design feature may or may not be included in the other stake/spike designs previously detailed.

FIG. 5D illustrates a hard surface base 200 having adjustable feet 202. The tripod embodiment could also serve as a hard surface base. The wide diameter allows the drink holder to be supported on hard surfaces, such as concrete, decks, indoors, etc.

Returning to FIG. 1, the leg of the beverage holder, as noted is comprised of two sections, 12 and 14. At one end of the holder leg is the ground support, as described. At the other end of the legs are a plurality of arms. The end of each arm has a beverage holder for holding one or more beverages.

In this illustrated embodiment, each of the arms is comprised of a bottom strut 10*a*–10*d*, and a top strut 24*a*–24*d*. Each of the top struts 24*a*–24*d* are secured at one end to upper hub 32 at pivot location 26*a*–26*d*. At a second end, each of the struts is fixedly secured to bracket 40*a*–40*d*. Bottom struts 10*a*–10*d* are mounted on two pivoting mounts, on a first end to lower hub 30 at location 36*a*–36*d* and at a second end to pivot mount 43*a*–43*d* on bracket 40*a*–40*d*. Lower hub 30 is mounted on leg section 12 such that it may slide up and down. It may also be held in a fixed position by a lock that holds lower hub 30 in a fixed location. The lock may be released allowing lower hub 30 to slide on leg section 12. In this manner the arms may be lowered to a lowered position. In this lowered position, the device may be stored in a bag and transported. The lowered position greatly reduces the bulk of the device.

At the end of each of the arms is a beverage holder 51*a*–51*d* which is affixed to brackets 40*a*–40*d*. Each of the beverage holders includes a well for holding a bottle, can, disposable beverage cup, or tumbler shaped glass and an additional holder for holding glasses having a stem. The upper part of the drink holder may be molded as part of brackets 40*a*–40*d*. The ends of straps 46*a*, 46*b* are held on the molded rim of bracket 40 by pins 44*a*, 44*b* and 44*c*, 44*d* respectively. Straps 46*a*, 46*b* also extend through bottom platform 42. This combination of secured straps 46*a*, 46*b* and bottom platform 42 forms a drink holding well. This well can hold a variety of containers including cans, bottles (including wine bottles) and cylindrical tumbler style glasses among other types of beverage containers. Also mounted on brackets 40*a*–40*d* is an open circle wine glass holder 50. The stem of a wine glass may be passed though the gap and the sides of the glass rest against the semicircular retaining portion, holding the glass in place. In this manner both the drink retaining well holder and the open circle holder may hold one beverage simultaneously. Mounted on the rim of the open well holder may be a number of open circle wine glass holders, allowing more drinks to be retained on the holder.

FIG. 2 shows the holder of FIG. 1 with the arms in the lowered position. In this view only two of the arms are illustrated. Extending from upper hub 32 are struts 24*a*, 24*b*. These are fixedly mounted on bracket 40*a*, 40*b*. The struts have pivoted downward, such that they are substantially parallel with the leg section 12. Lower hub 30 has been lowered, also bringing strut 10*a*, 10*b* into a parallel position with the leg section 12. On bracket 40*a*, 40*b* the straps 46*a*, 46*b* are made of a flexible material, such as a nylon weave and dangle downward. Platform 42 is also able to dangle downward at the end of straps 46*a*, 46*b*. In this lowered position the device takes up minimal space. The device may be placed in a storage bag and stored for later use.

A number of alternative embodiments are possible. The number of arms may be varied. Additional arms may be added to a design for holding more drinks. The initial embodiment does not include a table top. Such a top may or may not be included. If the top is included, it will be engineered in such a manner to allow the drink holding device to continue to be collapsible for transport and storage. This would include removable tops, foldable tops, and sectional tops.

Figure 3:
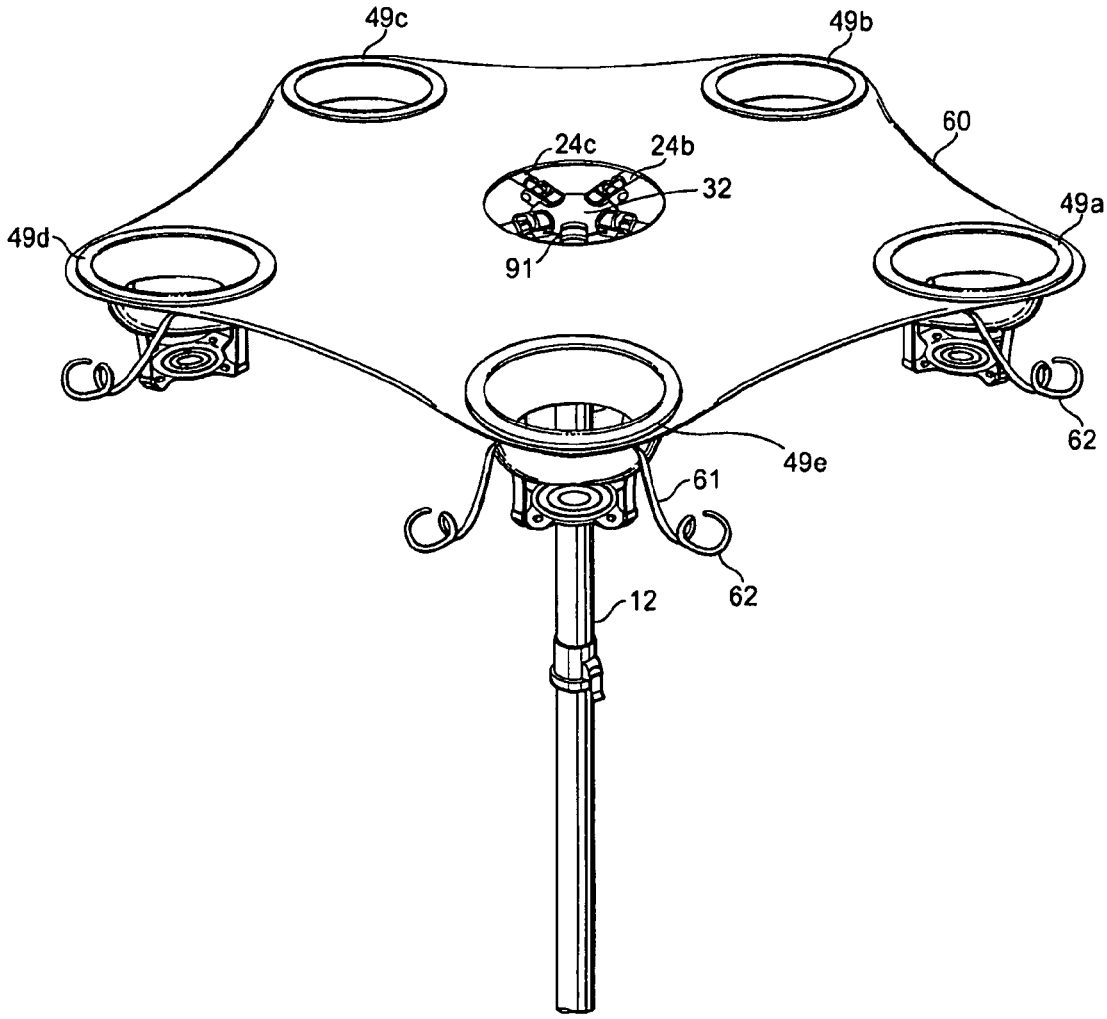
FIG. 3 is a top angled view of an embodiment of the device having five arms.
Figure 4:
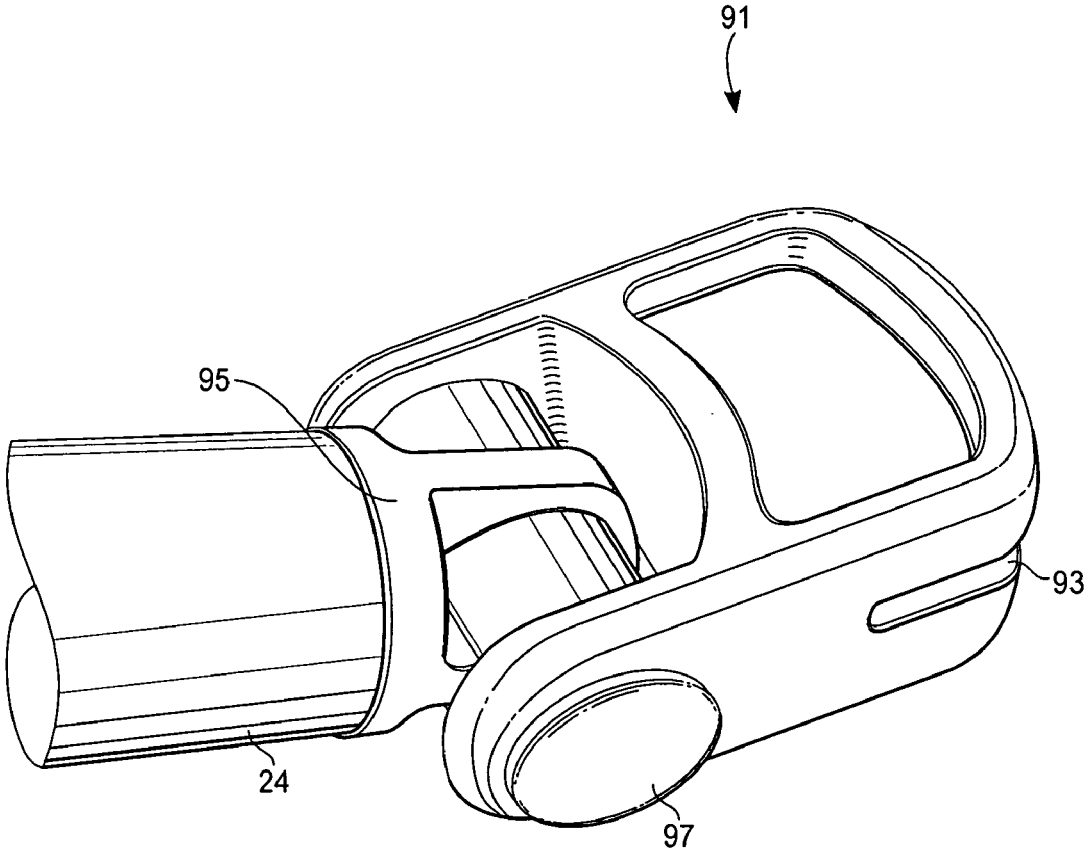
FIG. 4 is a perspective view of an end node.

With respect to FIG. 3, the device including a table top is shown. The table top 60 is secured to the beverage holders 49*a*–49*e*. The table top fabric folds down like an umbrella and unfolds or deploys taught to form a surface that is reasonably rigid. The struts 24*b*, 24*c* (as well as the three struts not shown) help give the table top stability and rigidity. Each of the struts ends in an end node 91. FIG. 4 illustrates the end nodes. End node 91 is attached to strut section 24 by cap 95 which may be tapered to frictionally lock onto the strut end. Similar end cap pieces may be used on all the ends of the struts to finish the ends of the struts and provide a mechanical attachment point. The struts may be made of metal tubing and end pieces may be made of hard plastic. Again with reference to FIG. 4, the pivot 97 (e.g., rivet, screw, or similar feature) on this part allows the attached strut to pivot. Groove 93 allows the end node to attach the associated strut to a common hub.

Returning to FIG. 3, the upper hub 32 may be a simple, laser cut sheet metal part into which each end node is inserted. Such a hub would be used for holders having any number of arms and associated drink holders. The hub may be mounted over leg section 12 or may be attached or otherwise part of section 12.

In this embodiment wine glass holder open loops 62 are attached by a mounting bar 61 to the drink holders 49*a*–49*e*. These holders may be constructed with a simple snap on design to attach to the drink holders 49*a*–49*e*. By allowing multiple removable wine glass holder loops 62 to be attached to each drink holder, a large number of drinks may be accommodated.

Figure 6:
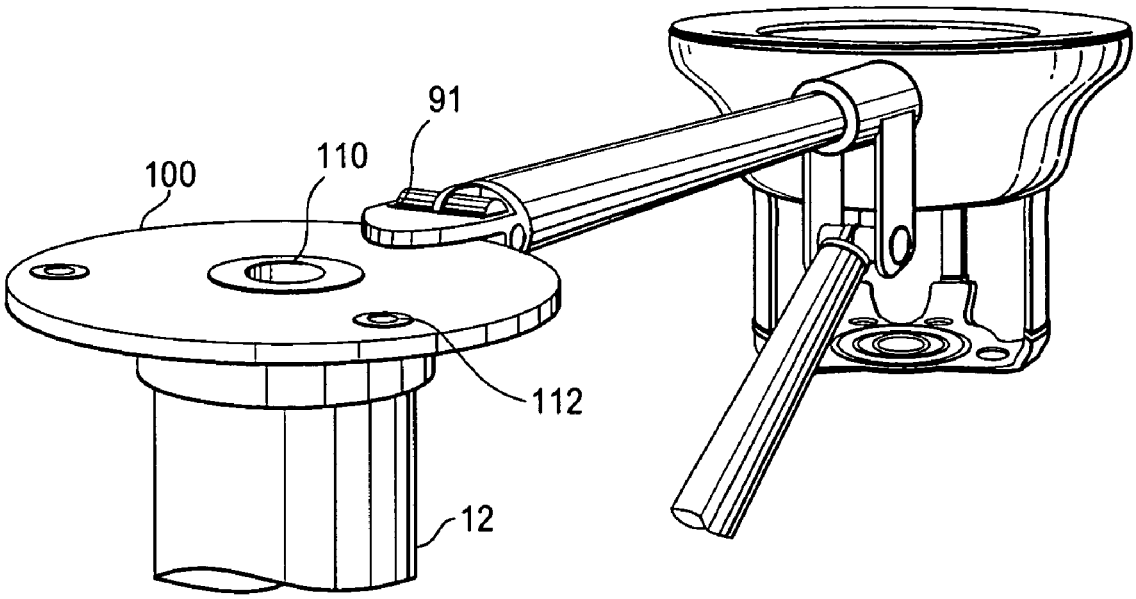
FIG. 6 is a side ended view of a center hub.

In FIG. 6, the hub is mounted atop the device leg. A number of end nodes 91 (one pictured) may be attached to the hub via side holes 112. The hub is snap fit or screw fit onto the top of the leg section 12. Center hole 110 may be used to mount accessories.

Figure 7:
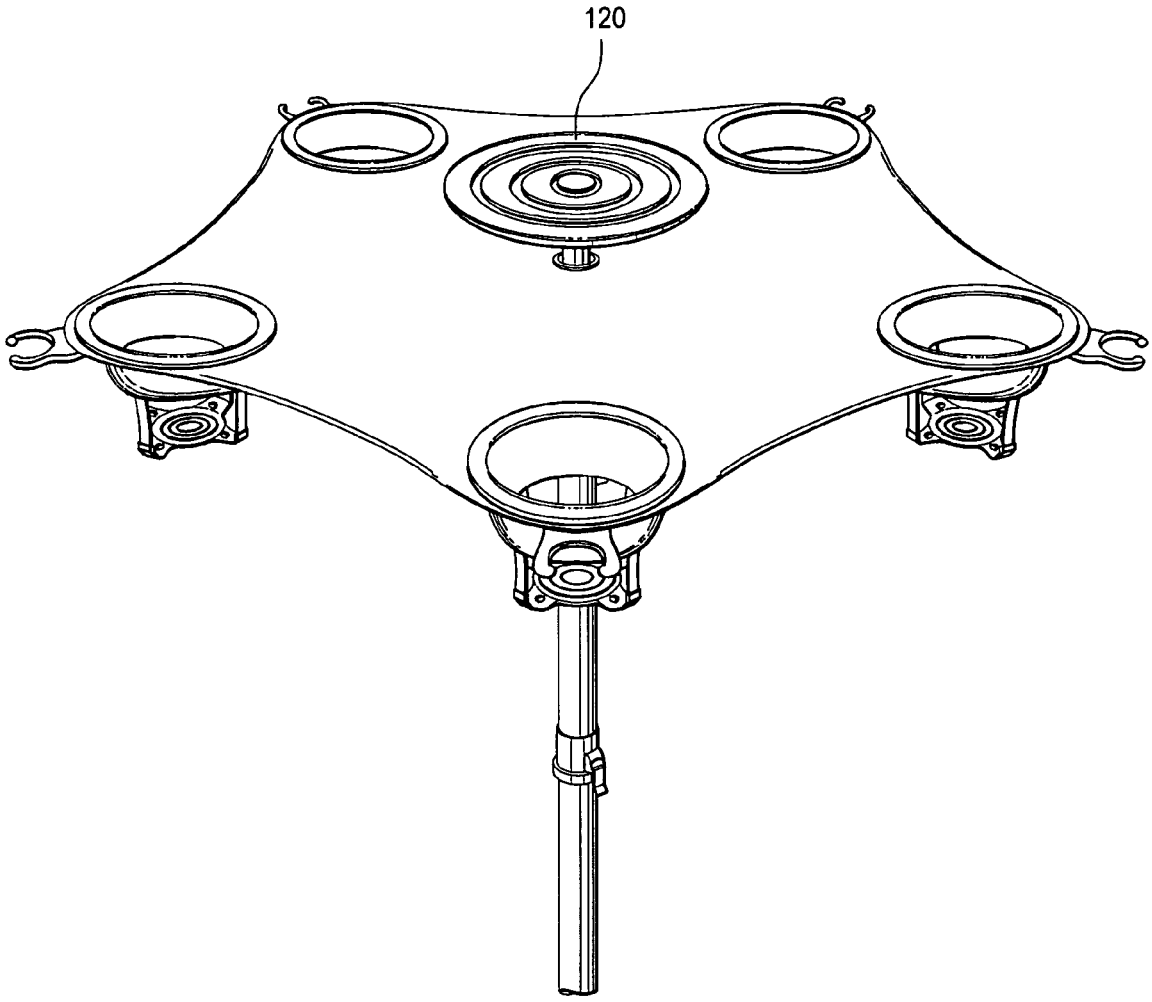
FIG. 7 is a view including a top platform.

FIG. 7 illustrates a beverage holder with a mounted accessory platform 120, mounted on the hub. Other accessories, such as a wine bucket, beer bucket, or other device could also be used mounted to the accessory mount.

The previous examples of invention may be modified in a number of ways. The materials set out in this application are examples of materials that could be used in fabrication. However, a variety of materials, including wood, metal, and plastic among others could be adapted. The struts are illustrated as tubes. However, dual wire struts, I beam sections, or other designs are possible. The holders are shown having a single locked position. However, it is also possible to design a lock having two locking positions or a variable locking position that positions the arm in a partially raised position (for example with the top struts positioned at a 45 degree angle with respect to the leg). For the present purposes, this would be still considered substantially perpendicular to the leg. This would save some space while still allowing bottles to be retained without spilling. The holders could be adjustable at the point of attachment to the arms such that the drink holder remained level. The drink holders could be insulated, mesh nets, or other similar drink well devices.

The present holder may be sold with a storage bag. Such a bag may include a shoulder strap for simplified transport of the device.

Setup and take down of such a device is quite easy. After the device has been secured or placed on the ground, simply sliding the lower ring into a locked position both brings the table top into the taught position (if a table top is included) and positions all of the arm in the perpendicular position. In addition, additional wine glass holders may be added in some of the designs.

What is claimed is:

1. A portable drink holder device comprising:

a leg;

a ground support at a first end of said leg;

a plurality of arms mounted on said leg, said arms movable from a raised position to a lowered position;

an arm lock able to hold said plurality of arms in said raised position;

a plurality of beverage holders, at least one beverage holder at the end of each arm; and a fabric top attached to said plurality of beverage holders such that when said arms are in the raised position said fabric top forms a planar surface; wherein said fabric top extends around a plurality of drink holder rims.

2. The device of claim 1, wherein height of said leg is adjustable.

3. The device of claim 1, wherein said ground support is selected from a group consisting of a spike, an auger, a stirrup structure, and a hard surface base.

4. The device of claim 1, wherein said at least one said beverage holder includes both a wine glass holder configured to hold glassware having a stem and a well drink holder.

5. The device of claim 1, wherein each arm is comprised of two struts, each strut joined to said leg by a ring mount.

6. The device of claim 1 further including an accessory mount at a second end of said leg.

7. The device of claim 1, wherein said ground support is detachable from said leg, said ground support including a hammer point.

8. The device of claim 1, wherein each of the plurality of arms is joined to a ring mount mounted on said leg such that raising said ring mount raises all of the plurality of arms.

9. A portable drink holder device comprising:

a leg;

a ground support at a first end of said leg;

a plurality of arms mounted on said leg, said arms movable from a raised position to a lowered position;

an arm lock able to hold said plurality of arms in said raised position;

a plurality of beverage holders, at least one beverage holder at the end of each arm; and a fabric top attached to said plurality of beverage holders such that when said arms are in the raised position said fabric top forms a planar surface; wherein each of the plurality of arms includes a bottom strut pivotably mounted at a first bottom strut end onto a ring slidably mounted on the leg and each of the plurality of arms includes a top strut pivotably mounted at a first top strut end onto a top of the leg.

10. A portable drink holder device comprising:

a leg;

a ground support at a first end of said leg;

a plurality of arms mounted on said leg, said arms movable from a raised position to a lowered position;

an arm lock able to hold said plurality of arms in said raised position;

a plurality of beverage holders, at least one beverage holder at the end of each arm; and a fabric top attached to said plurality of beverage holders such that when said arms are in the raised position said fabric top forms a planar surface; wherein each drink holder includes drink holder bracket and wherein each arm includes: a) a top strut non-pivotably mounted on one drink holder bracket; and b) a bottom strut pivotably mounted on one drink holder bracket.

11. A portable drink holder device comprising:

a leg;

a ground support at a first end of said leg;

a plurality of arms mounted on said leg, said arms movable from a raised position to a lowered position;

an arm lock able to hold said plurality of arms in said raised position;

a plurality of beverage holders, at least one beverage holder at the end of each arm; and a fabric top attached to said plurality of beverage holders such that when said arms are in the raised position said fabric top forms a planar surface; wherein each drink holder includes a rim attached to one of said plurality of arms, a bottom platform and a platform of straps attaching said bottom platform to said rim.

12. The device of claim 11, wherein height of said leg is adjustable.

13. The device of claim 11, wherein said ground support is selected from a group consisting of a spike, an auger, a stirrup structure, and a hard surface base.

14. The device of claim 11, wherein said at least one said beverage holder includes both a wine glass holder configured to hold glassware having a stem and a well drink holder.

15. The device of claim 11, wherein each arm is comprised of two struts, each strut joined to said leg by a ring mount.

16. The device of claim 11 further including an accessory mount at a second end of said leg.

17. The device of claim 11, wherein said ground support is detachable from said leg, said ground support including a hammer point.

18. The device of claim 11, wherein each of the plurality of arms is joined to a ring mount mounted on said leg such that raising said ring mount raises all of the plurality of arms.

* * * * *